US007624775B2

(12) United States Patent
Smith et al.

(10) Patent No.: US 7,624,775 B2
(45) Date of Patent: Dec. 1, 2009

(54) POWER PLANER

(75) Inventors: Allison A. Smith, Baltimore, MD (US); Jyh Cherng Lin, Timonium, MD (US); Todd J. Huston, Lutherville, MD (US); David L. Wikle, York, PA (US); Robert P. Welsh, Hunt Valley, MD (US); Daniel H. Montague, New Freedom, PA (US); Larry T. Albert, Abingdon, MD (US); Barry Wixey, Sanibel, FL (US); Bor Yann Chuang, Taipin (TW); Leo Chang, Darli (TW); Chin Long Chi, Taichung (TW)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/143,313

(22) Filed: Jun. 20, 2008

(65) Prior Publication Data

US 2008/0264519 A1 Oct. 30, 2008

Related U.S. Application Data

(63) Continuation of application No. 10/853,462, filed on May 25, 2004.

(60) Provisional application No. 60/490,647, filed on Jul. 28, 2003.

(51) Int. Cl.
*B27C 1/00* (2006.01)

(52) U.S. Cl. ..... 144/114.1; 144/117.1; 409/206

(58) Field of Classification Search ..... 144/114.1, 144/117.1, 129, 130; 409/206, 208, 210, 409/218

See application file for complete search history.

(56) References Cited

U.S. PATENT DOCUMENTS

| | | | | |
|---|---|---|---|---|
| 2,577,975 | A | 12/1951 | Moore | |
| 2,908,301 | A | 10/1959 | Baumbach et al. | |
| 5,725,035 | A * | 3/1998 | Shadeck | 144/117.1 |
| 5,771,949 | A * | 6/1998 | Welsh et al. | 144/130 |
| 5,988,239 | A * | 11/1999 | Chen | 144/129 |
| 6,089,287 | A | 7/2000 | Welsh et al. | |
| 6,131,628 | A | 10/2000 | Chiang | |
| 6,283,180 | B1 * | 9/2001 | Chiang | 144/130 |
| 6,283,181 | B1 * | 9/2001 | Chiang | 144/130 |
| 6,289,951 | B1 * | 9/2001 | Chiang | 144/130 |
| 6,289,956 | B1 | 9/2001 | Shriver | |
| 6,308,754 | B1 | 10/2001 | Chang | |
| 6,308,755 | B1 * | 10/2001 | Chiang | 144/130 |

(Continued)

OTHER PUBLICATIONS

U. Frisch, Partial European Search Report, Application No. EP 08 16 8659, Jan. 22, 2009, Munich.

*Primary Examiner*—Shelley Self
(74) *Attorney, Agent, or Firm*—Michael Aronoff; Adan Ayala

(57) ABSTRACT

A planing machine including a base, at least two support columns disposed on the base, and a carriage assembly carrying a cutterhead. The carriage assembly may be mounted on the support columns. At least one of the base and the carriage assembly is movable vertically towards the other of the base and the carriage assembly. The planing machine may have panel mounted on at least one of the base and the carriage assembly and extending between the carriage assembly and the base housing for preventing user contact with the cutterhead.

5 Claims, 13 Drawing Sheets

U.S. PATENT DOCUMENTS 6,343,631 B1 2/2002 Chiange
6,510,879 B1 1/2003 Chuang
6,951,231 B2 * 10/2005 Garcia et al. ..... 144/117.1
2002/0174912 A1 11/2002 Wixey et al.
2003/0024601 A1 2/2003 Garcia et al.
2007/0034289 A1 * 2/2007 Smith ..... 144/117.1

* cited by examiner

POWER PLANER

CROSS-REFERENCE TO RELATED APPLICATION

The present application is a continuation of U.S. patent application Ser. No. 10/853,462, filed on May 25, 2004, now pending, the entire contents of which is herein incorporated by reference.

FIELD OF THE INVENTION

The present invention generally relates to improvements in power tools and more specifically to improvements that are particularly well suited for use with woodworking power tools such as power planers.

BACKGROUND OF THE INVENTION

Various power tools are used in woodworking in an effort to efficiently and accurately form workpieces to desired dimensions and with a desired surface finish. As is widely known, planing machines are often used for surface planing of wooden boards. A conventional planing machine typically includes one or two rotatably mounted cutting blades attached to a vertically movable carriage assembly. Also known are jointer machines which are typically used for the edge planing of wood. In certain applications, the functions of conventional planing machines and jointers are combined within a single unit commonly referred to as a jointer/planer machine.

In a typical wood planing machine, such as a surface planer, a selectively adjustable workpiece opening is defined between a carriage assembly and the planing surface of the base of the machine. The rotationally mounted blades are carried on the underside of the carriage assembly adjacent to the workpiece opening. The blades are adapted to remove a predetermined amount of material from the workpiece depending on the thickness of the workpiece and the height of the workpiece opening. The carriage assembly also usually includes one or more feed rollers which urge the workpiece through the workpiece opening during the operation of the wood planing machine.

In most applications, the carriage assembly of a wood planing machine is movably mounted to a plurality of support columns for movement with respect to the planing surface. Such movement of the carriage assembly adjusts the vertical dimension of the workpiece opening so as to selectively determine the amount of material to be removed from the workpiece. Alternatively, the carriage assembly may be fixed and the planing surface adjusted vertically with respect to the carriage assembly so as to adjust the vertical dimension of the workpiece opening.

Typically, a shroud covers the support columns and/or the carriage assembly. However, such shroud adds to the weight of the machine. Accordingly, it is preferable to provide a means to minimize the weight of the machine.

SUMMARY OF THE INVENTION

In accordance with the present invention, an improved planing machine is employed. The planing machine may include a base, at least two support columns disposed on the base, a carriage assembly carrying a cutterhead, the carriage assembly being mounted on the support columns, one of the base and the carriage assembly being movable vertically towards the other of the base and the carriage assembly, and a panel mounted on one of the base and the carriage assembly and extending between the carriage assembly and the base housing for preventing user contact with the cutterhead.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which:

FIGS. 2-3 illustrate the auxiliary table being installed on the planing machine, whereas

FIG. 4 illustrates different panel means, whereas

FIG. 5 illustrates a material removal gauge assembly, whereas

FIG. 6 illustrates a switch assembly, whereas

FIG. 7 illustrates a cord retaining assembly, whereas

FIG. 13 illustrates an exhaust assembly to be used with the planing machine, whereas

FIG. 14 illustrates a second exhaust assembly to be used with the planing machine, whereas

DETAILED DESCRIPTION

Figure 1:
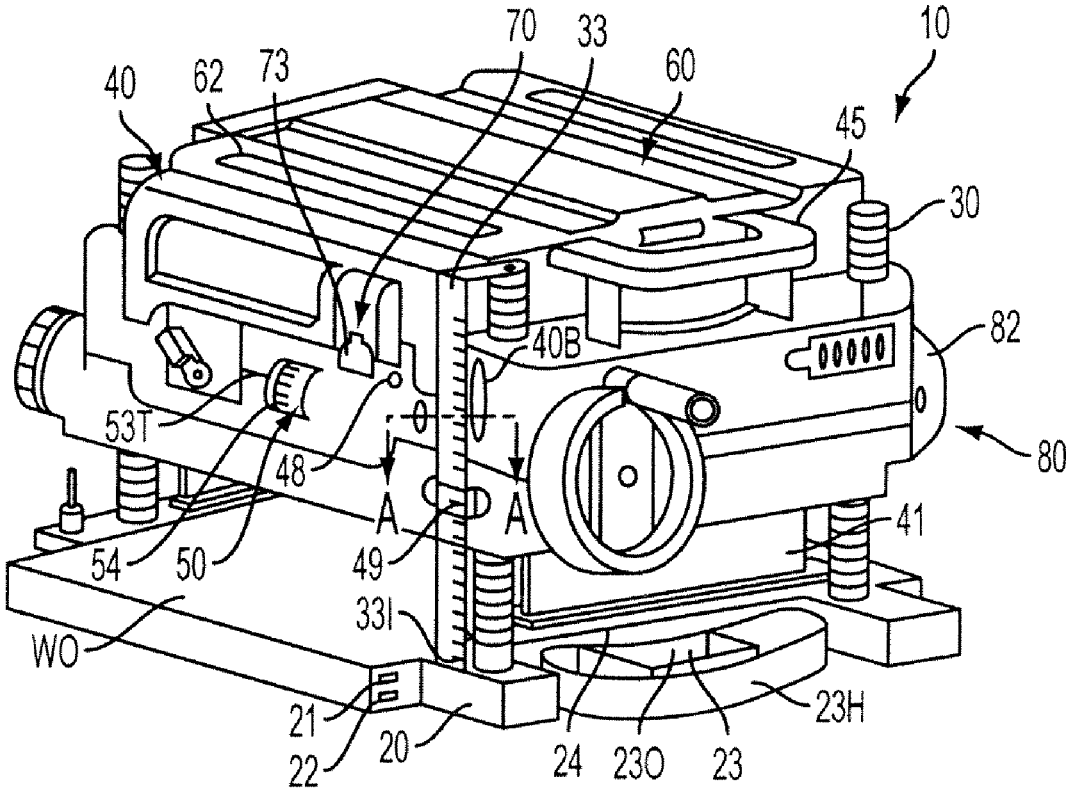
FIG. 1 is a perspective view of a planing machine constructed in accordance with the teachings of the present invention.

With reference to FIG. 1, a planer mechanism constructed in accordance with the teachings of the present invention is generally indicated by reference numeral 10. Planer mechanism 10 may include a base assembly 20, at least two (and preferably four) support columns 30, and a carriage assembly 40 mounted unto the support columns 30. Carriage assembly 40 may carry a motor, a cutterhead driven by the motor and/or feed rollers driven by the motor, as is well known in the art.

Persons skilled in the art will recognize that carriage assembly 40 may threadably engage support columns 30. Persons skilled in the art are directed to US Published Patent Application No. 2002-0174912, which is incorporated herein by reference, for further information on how the carriage assembly 40 is mounted unto the support columns 30 to allow adjustment of the distance between carriage assembly 40 and base assembly 20. Nonetheless, persons skilled in the art will recognize that base assembly 20 may be movably mounted unto support columns 30 to allow adjustment of the distance between carriage assembly 40 and base assembly 20.

Base assembly 20 may include handles 23 for enabling the user to easily carry planing machine 10. Preferably, base assembly 20 has an opening 23O, which is at least partially surrounded by a handle portion 23H. Handle portion 23H is preferably substantially horizontal. With such arrangement, the use can wrap his/her hand around handle portion 23H and comfortably insert his/her fingers into opening 23O.

Figure 2A:
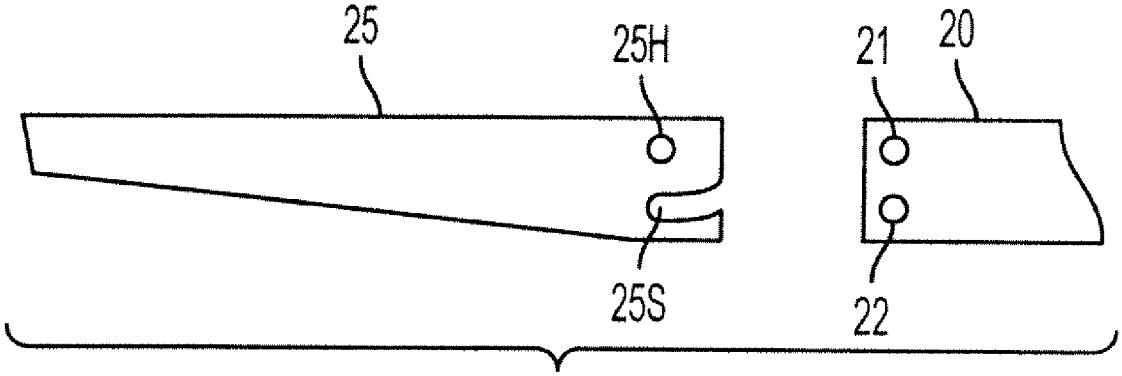
FIGS. 2A-2B are side views of the auxiliary table before being installed and being installed, respectively.
Figure 2B:
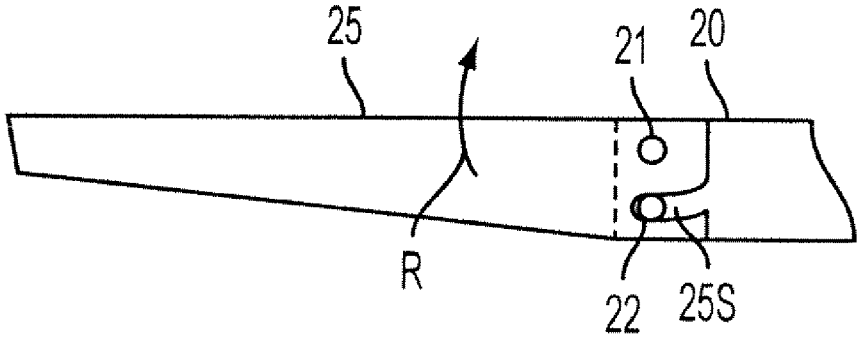
Figure 3A:
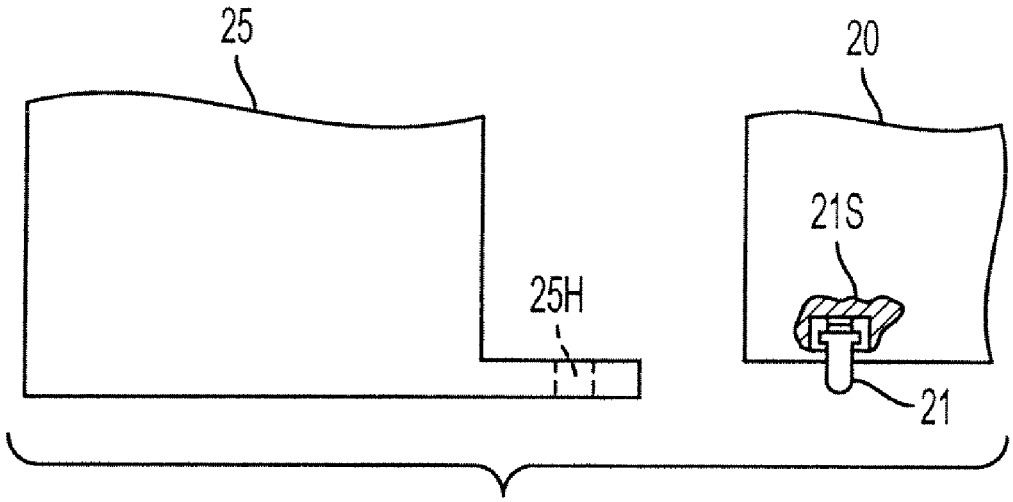
FIGS. 3A-3B are top views of the auxiliary table before being installed and being installed, respectively.
Figure 3B:
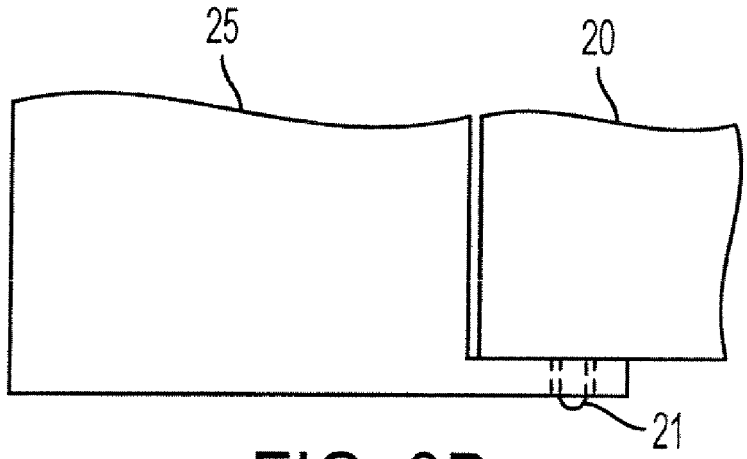

Referring to FIGS. 2-3, auxiliary tables 25 may be attached to the front and/or rear of base assembly 20. Base assembly 20 may have first and second posts (21 and 22, respectively). First post 21 is preferably movable between extended and retracted positions. A spring 21S preferably biases the first post towards the extended position.

Auxiliary table 25 preferably has a hole 25H for receiving the first post 21 and a slot 25S for receiving the second post 22. With such arrangement, the user would dispose auxiliary table 25 unto base assembly 20 so that the holes 25H match the first posts 21. As the user disposes auxiliary table 25, first posts 21 would move towards the retracted position. When holes 25H align with first posts 21, springs 21S will move first posts towards the extended position.

The user then pivots auxiliary table 25 about first posts 21. Persons skilled in the art will recognize that the final position of auxiliary table 25 is dependent upon the end of slot 25S, as auxiliary table 25 cannot pivot any further once second post 22 contacts the end of slot 25S. Accordingly, it is preferable to ensure that the slot 25S is shaped so that such contact will occur when auxiliary table is substantially horizontal and/or coplanar with base assembly 20.

As shown in FIG. 1, planing machine 10 does not have a shroud covering support columns 30 and/or carriage assembly 40. Accordingly, it is preferable to provide a means to prevent or discourage the user from reaching underneath the carriage assembly. FIG. 4 illustrates several embodiments of such means.

Figure 4A:
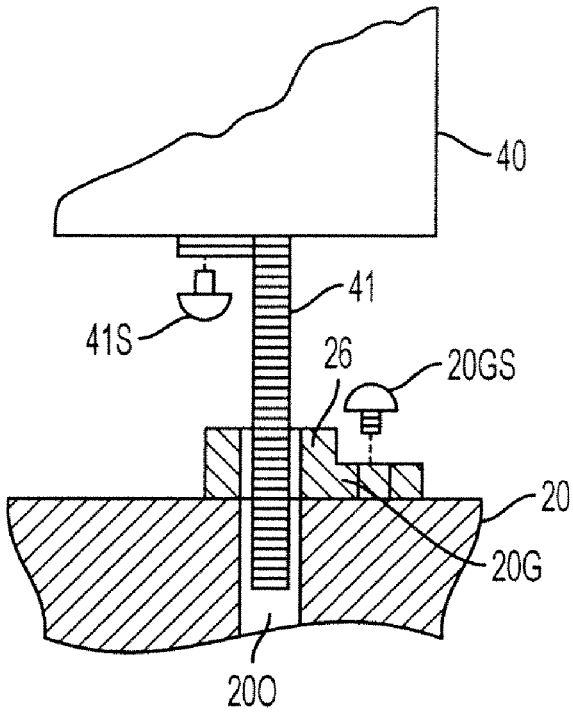
FIGS. 4A-4C are the first, second and third embodiments, respectively.

Referring to FIG. 4A, a wall 41 may be attached to carriage assembly 40. Preferably wall 41 is attached via screws 41S. The height of wall 41 may be substantially equal to or less than the largest possible distance between base assembly 20 and carriage assembly 40. Base assembly 20 may have a slot 20O for receiving wall 41 therethrough. Accordingly, as carriage assembly 40 is moved towards the base assembly 20, wall 41 may enter and move through slot 20O.

An auxiliary wall 20G may be provided on base assembly 20. Auxiliary wall 20G may be attached to base assembly 20 via screws 20GS, and have a slot for receiving wall 41 therethrough. Persons skilled in the art will recognize that the height of wall 41 may be decreased if auxiliary wall 20G is used in conjunction therewith to approximate the largest possible distance between base assembly 20 and carriage assembly 40.

Persons skilled in the art will recognize that wall 41 and opening 20O may alternatively be disposed unto base assembly 20 and carriage assembly 40, respectively.

Figure 4B:
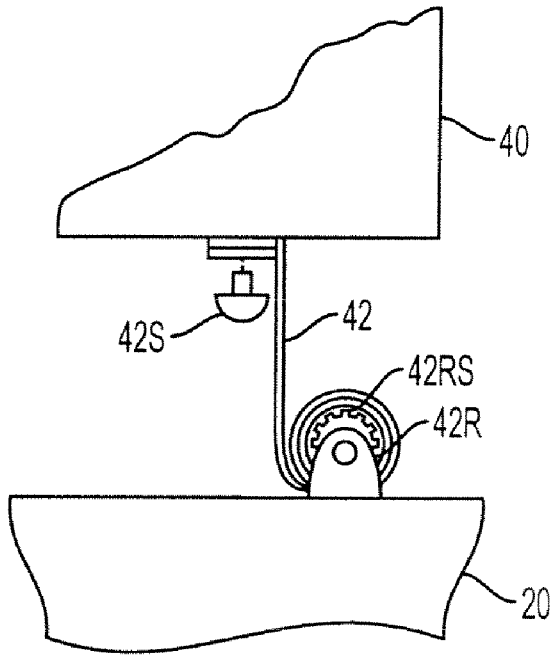

Referring to FIG. 4B, wall 42 is preferably attached to carriage assembly 40 via screws 42S. Wall 42 may be substantially flexible and wrapped around a roller 42R, which may be rotationally attached to base assembly 20. Roller 42R may have a spring 42RS for biasing roller 42 towards a wrapping position. Persons skilled in the art will recognize that roller 42R would act in a similar manner to the spring-biased rollers found in window shades.

With such arrangement, when carriage assembly 40 is raised, roller 42R rotates therewith, increasing the tension on spring 42RS. When carriage assembly 40 is lowered, roller 42R then rotates to wrap wall 42 therearound due to spring 42RS.

Persons skilled in the art will recognize that wall 42 and roller 42R may alternatively be disposed unto base assembly 20 and carriage assembly 40, respectively.

Figure 4C:
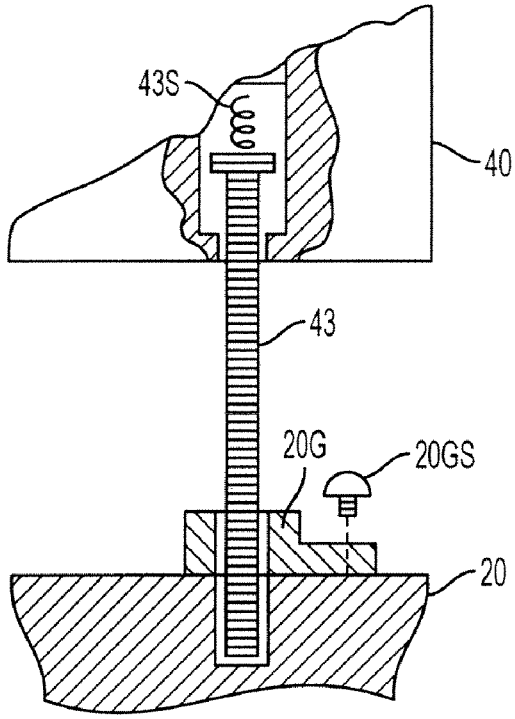

Referring to FIG. 4C, wall 43 may be movably mounted unto carriage assembly 40. Wall 43 may be moved between an extended position and a retracted position. A spring 43S may bias wall 43 towards the extended position.

Preferably, wall 43 extends into a slot on base assembly 20 and/or auxiliary wall 20G. Persons skilled in the art will recognize that wall 43 may alternatively be movably mounted unto base assembly 20.

Figure 5A:
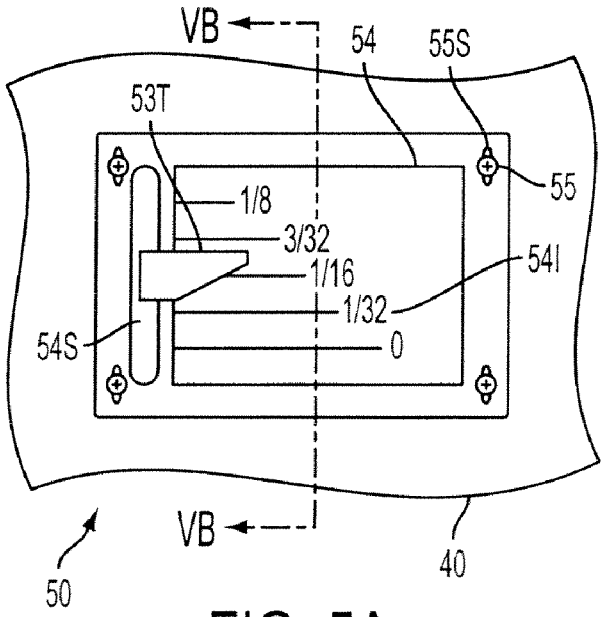
FIG. 5A is a front view of a portion of the assembly.
Figure 5B:
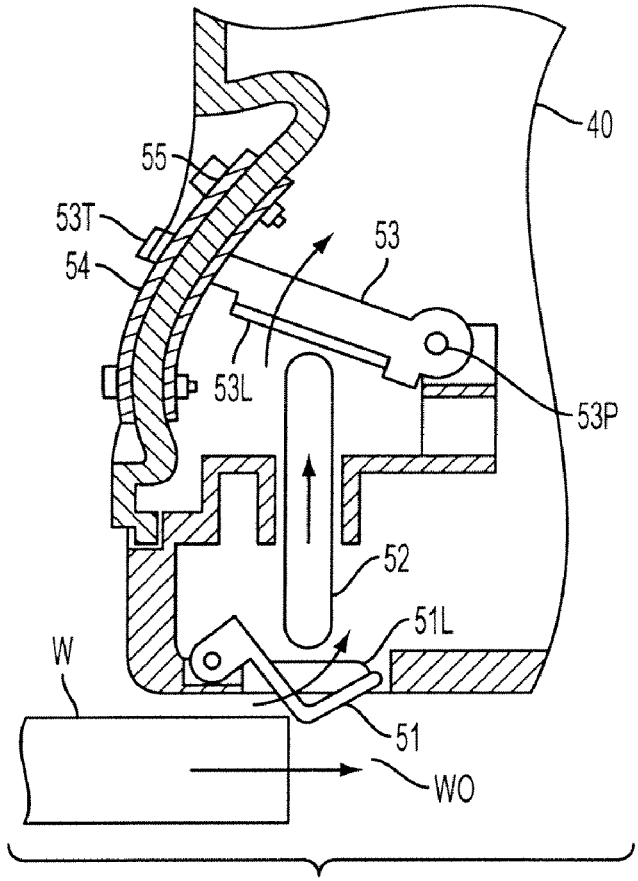
FIG. 5B is a cross-sectional view along line VB-VB of FIG. 5A.
Figure 5C:
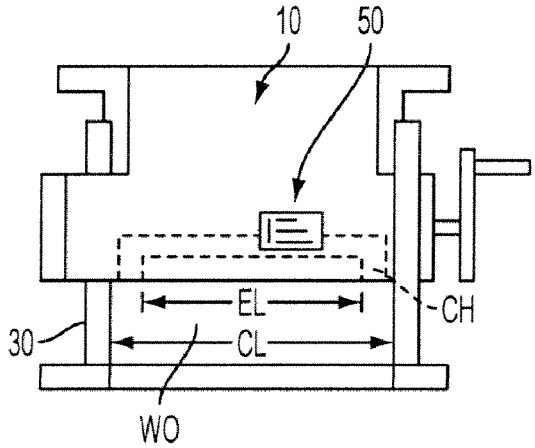
FIG. 5C is a front view of the planing machine.

Referring to FIGS. 1 and 5, a material removal indicator assembly 50 of the present invention will now be described. The material removal indicator assembly 50 may include a workpiece engagement member 51 pivotally attached to the carriage assembly 40, a link 52 contacted by the workpiece engagement member 51, an indicator 53 pivotally attached to the carriage assembly 40 and contacted by the link 52, and a scale 54 disposed on the carriage assembly 40.

Preferably workpiece engagement member 51 is made out of bent sheet metal, and it has a ledge 51L for contacting and moving link 52. Workpiece engagement member 51 preferably pivots about a substantially horizontal axis.

Link 52 may be captured by carriage assembly 40 so that it can only move along a substantially vertical direction. Link 52 may contact a ledge 53L of indicator 53.

Indicator 53 may extend through a slot 54S in the carriage assembly 40 and/or scale 54. Indicator 53 may further have a bent tab 53T for cooperating with scale 54 in indicating the amount of material being removed, as discussed below. Persons skilled in the art will recognize that indicator 53 preferably pivots about a substantially horizontal axis, which is substantially parallel to the pivoting axis of workpiece engagement member 51.

Scale 54 may be mounted unto carriage assembly 54 via screws 55. Scale 54 may have slots 55S through which screws 55 extend, in order to allow the user to adjust and calibrate the scale 54. Scale 54 may be stamped with indicia 54I incrementally representing the amount of material that is being removed from workpiece W during a pass through the workpiece opening. In one application, the scale 54 is stamped with indicia which begin at 0.05 inches and increases in increments by 0.05 inches.

With such arrangement, when workpiece W is inserted into workpiece opening WO, workpiece W engages workpiece engagement member 51, causing workpiece engagement member 51 to rotate. Such rotational action moves link 52 upwardly, which in turn causes indicator 53 to rotate.

Because the distance between link 52 and the pivot point 53P of indicator 53 is smaller than the distance between tab 53T and pivot point 53P, link 52 moves a shorter distance than tab 53T. In other words, the movement of link 52 (and thus of the pivotal displacement of the workpiece engagement member 51) is magnified by movement of the indicator 53 in front of the scale 54. As a result, small differences in the amount of material to be removed from the workpiece W may be readily discerned.

It is preferable to make the length EL of workpiece engagement member 51 as long as possible in order to react to a workpiece W being inserted anywhere along the workpiece opening WO. However, increasing the length EL also increases the weight of workpiece engagement member 51. Accordingly, it is preferable to ensure that length EL is at least half of the width CL of the workpiece opening WO, which is defined as either the length of the cutterhead CH or the distance between posts 30, whichever is smaller. It is also preferable to ensure that length EL is at most two thirds of the width CL of the workpiece opening WO. Thus, if the width CL of workpiece opening WO is 13 inches, the preferred length EL is between about 6.5 inches and about 8.67 inches.

Figure 6A:
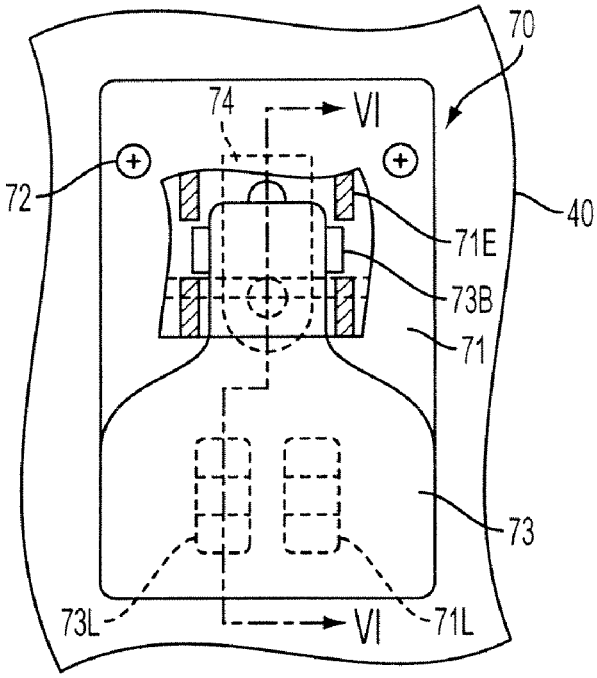
FIG. 6A is a front view of the switch assembly and FIG. 6B is a cross-sectional view along line VI-VI of FIG. 6A.
Figure 6B:
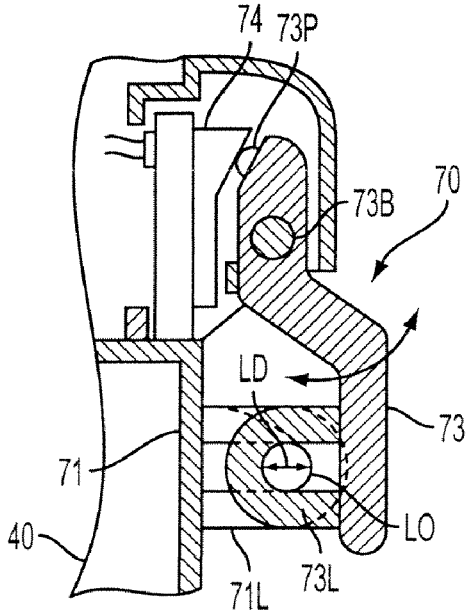

Referring to FIGS. 1 and 6, a switch assembly 70 for controlling the flow of electricity into the motor will now be described. The switch assembly 70 may include a body 71 mounted unto carriage assembly 40 (preferably via screws 72), a paddle 73 pivotably mounted unto body 71, and a switch 74 disposed on body 71 and activated by paddle 73.

In particular, paddle 73 may have pivot bosses 73B which are rotatably disposed within ears 71E of body 71 to allow the rotational movement of paddle 73 between "on" and "off" positions. Paddle 73 may have protrusions 73 which contact switch 74 to move the switch between the "on" and "off" positions.

Switch assembly 70 may also have a means for locking so that the planing machine 10 cannot be used without authorization. In particular, body 71 and paddle 73 may have loops 71L, 73L, respectively. When paddle 73 is moved to the "off" position, loops 71L, 73L will be aligned to define an opening LO through which the shackle of a padlock can be inserted for locking the switch assembly 70. Preferably the diameter LD of opening LO is between about 0.25 inches and about 0.67 inches.

Figure 7A:
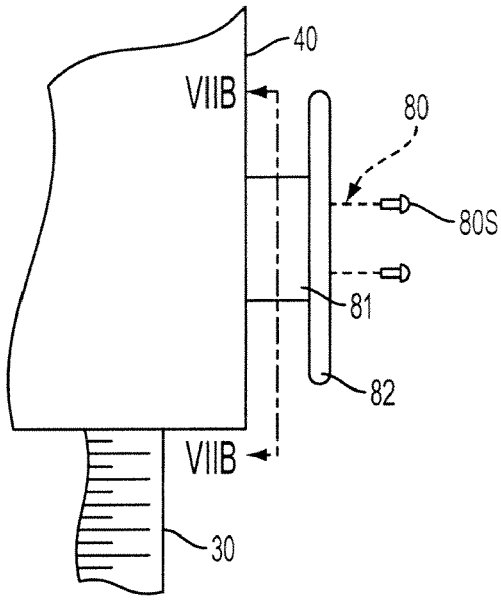
FIG. 7A is a side view of the cord retaining assembly and FIG. 7B is a cross-sectional view along line VIIB-VIIB of FIG. 7A.
Figure 7B:
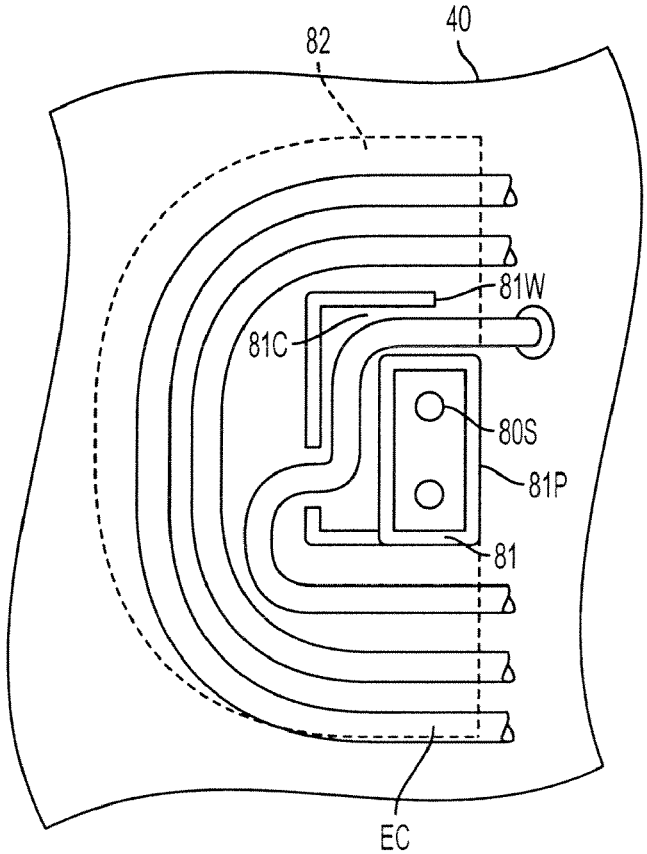

Referring to FIGS. 1 and 7, a wrap cord assembly 80 of the present invention will now be described. The wrap cord assembly 70 may include a post body 81 which is disposed on carriage assembly 40, and an ear 82 disposed on post body 81.

In particular, post body 81 may be affixed to carriage assembly 40 via screws 80S. Post body 81 may have a post 81P and a wall 81W which define a channel 81C. Channel 81C is wide enough to receive an electrical cord EC.

As mentioned above, ear 82 is disposed on post body 81. Ear 82 may be shaped in any decorative scheme as desired. Persons skilled in the art will recognize that the distance between ear 82 and carriage assembly 40 is at least the width of electrical cord EC, so that the electrical cord EC can be disposed therebetween.

Preferably two wrap cord assemblies 70 are disposed on the back of carriage assembly 40. Accordingly, the user can wrap the electrical cord EC about both wrap cord assemblies. Persons skilled in the art will recognize that the embodiment of FIG. 7 can be used in both left and right positions without any modifications to the cord wrap assembly 70.

During manufacture, it is preferable to route the electrical cord EC out of carriage assembly 40 through channel 81C of the first wrap cord assembly 70, then mount the first wrap cord assembly 70 unto carriage assembly 40, thereby capturing electrical cord EC between carriage assembly 40 and first wrap cord assembly 70. Then the electrical cord can be wrapped around the first and second wrap cord assemblies 70. Capturing electrical cord EC is advantageous as it minimizes the stresses on electrical cord EC if a user were to pull on electrical cord EC.

Figure 8:
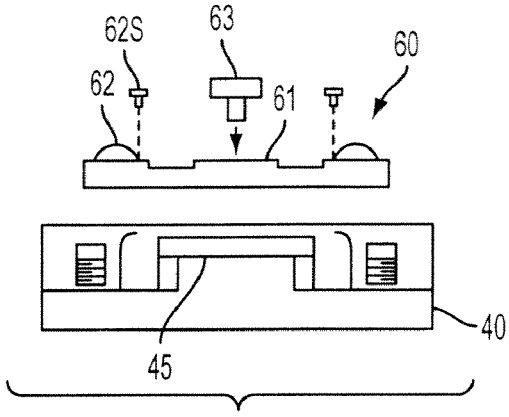
FIG. 8 is a partial side view of the planing machine.
Figure 9:
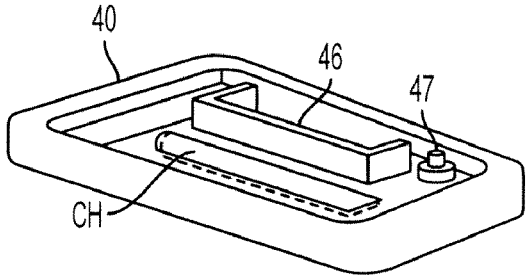
FIG. 9 is a perspective view of the planing machine with a removed cover.

Referring to FIGS. 1 and 8-9, planing machine 10 may have a removable top assembly 60. Top assembly 60 preferably has a body 61 and bumpers 62 which may be affixed to body 61 via screws 62S. Bumpers 62 may be made of plastic or metal, and are preferably smooth so that a user can place or slide a workpiece thereon without marring the workpiece.

The user can access the cutterhead CH, motor and/or feed rollers by removing top assembly 60 from carriage assembly 40. Carriage assembly 40 may also have a tray 46 for holding accessories, tools, knives, etc., which is preferably exposed when top assembly 60 is removed.

Figure 10:
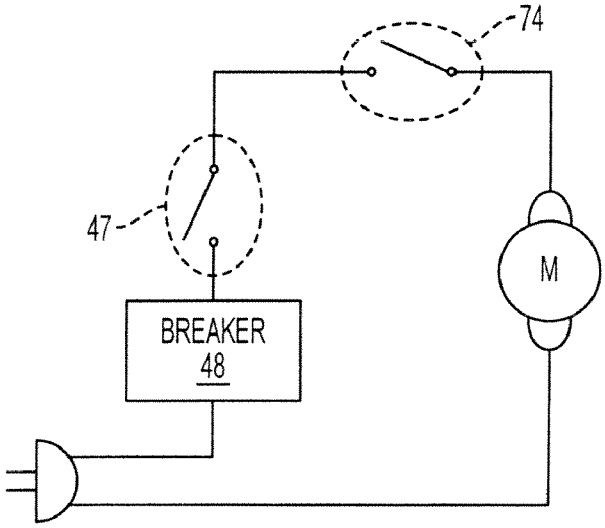
FIG. 10 is a schematic diagram of the electrical circuit for the planing machine.

It is preferable to provide a switch 47 on carriage assembly 40. Switch 47 is activated when top assembly 60 is disposed on carriage assembly 40. Such switch 47 is connected in series with switch 74 and motor M, as shown in FIG. 10. In addition, switch 47 may be connected in series to a breaker 48, which is preferably disposed next to switch assembly 70 on carriage assembly 40.

With such circuit, the motor M will not run if the top assembly 60 is removed from carriage assembly 40 as switch 47 will be opened. Motor M however will run when the top assembly 60 is placed on carriage assembly 40 as switch 47 will be closed.

Figure 11:
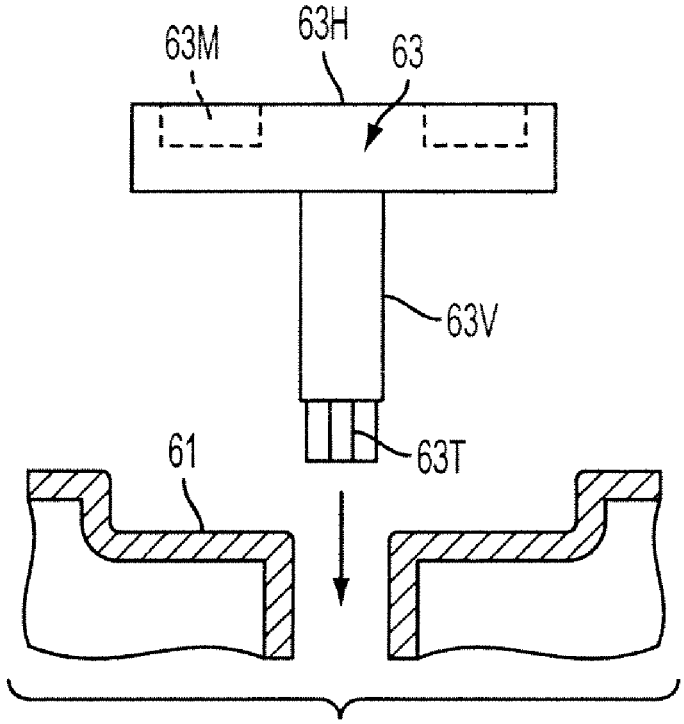
FIG. 11 is a side view of a hand tool being disposed on the planing machine.

Referring to FIGS. 8 and 11, a tool 63 may be disposed on top assembly 60 and/or carriage assembly 40. Tool 63 is preferably T-shaped, thus having a vertical portion 63V and a horizontal portion 63H substantially bisected by the vertical portion 63V. A bit 63T, such as a hex bit or a screwdriving bit, is preferably placed at the distal end of the vertical portion 63V. Preferably, the type of bit 63T can be engaged to the different screws or fasteners used in planing machine 10.

It is also preferable to dispose magnets 63M on the horizontal portion 63H. These magnets 63H can be used in handling the blades of cutterhead CH, as they typically made of ferrous metals.

Figure 12:
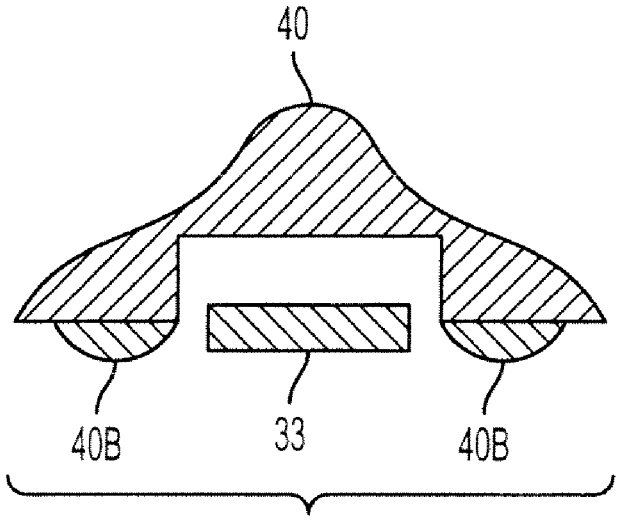
FIG. 12 is a partial cross-section along line A-A of FIG. 1.

Referring to FIGS. 1 and 12, a scale 33 may be attached to at least one of the base assembly 20 and a support column 30. Scale 33 may have indicia 331 indicative of the height of the workpiece opening WO. Preferably, a pointer 49 is attached to the carriage assembly 40 for indicating on scale 33 the height of the workpiece opening WO. Pointer 49 may be made of transparent plastic with an opaque line for indicating such height.

Carriage assembly 40 may have bumps 40B on both sides of scale 33 to protect it from being bent, etc.

Figure 13A:
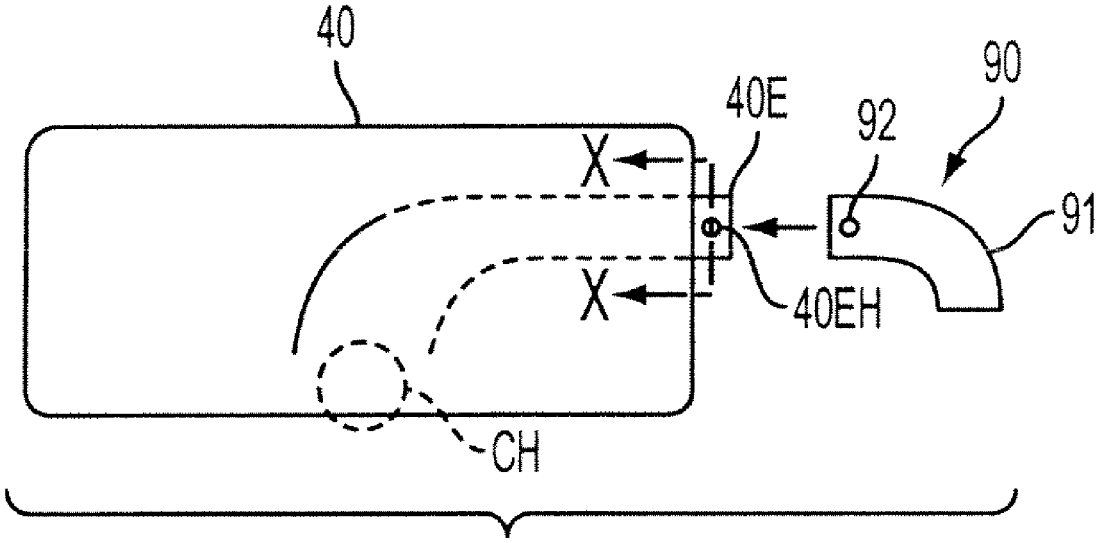
FIG. 13A is a side view of the exhaust assembly and FIG. 13B is a cross-sectional view along line X-X of FIG. 13A.
Figure 13B:
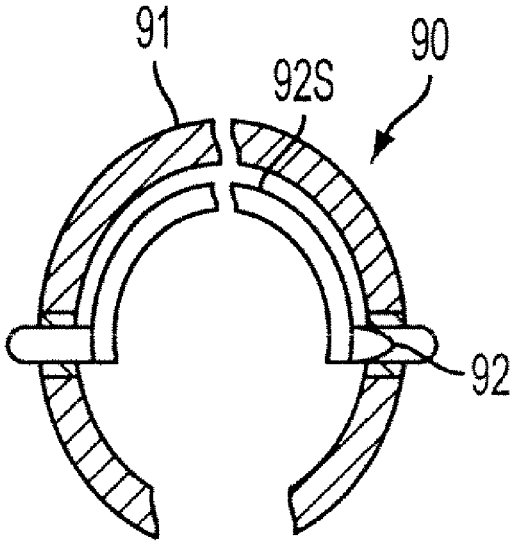

Referring to FIG. 13, carriage assembly 40 has a dust exhaust 40E. Persons skilled in the art are directed to US Published Patent Application No. 2002-0174912, which is incorporated herein by reference, for information on how dust generated by cutterhead CH during the planing operation exits through dust exhaust 40E.

An exhaust directing assembly 90 may be attached to the dust exhaust 40E. Preferably exhaust directing assembly 90 has a body 91, which may bend downwardly, and two movable detents 92 extending through the body 91. The detents 92 are movable between extended and retracted positions. Preferably, detents 92 are biased towards the extended position via a spring 92S, which may connect both detents 92.

With such arrangement, the user would just plug exhaust directing assembly 90 into dust exhaust 40E, causing detents 92 to move to the retracted position. When detents 92 align with holes 40EH on dust exhaust 40E, detents 92 will move to the extended position, locking exhaust directing assembly 90 in place.

Figure 14A:
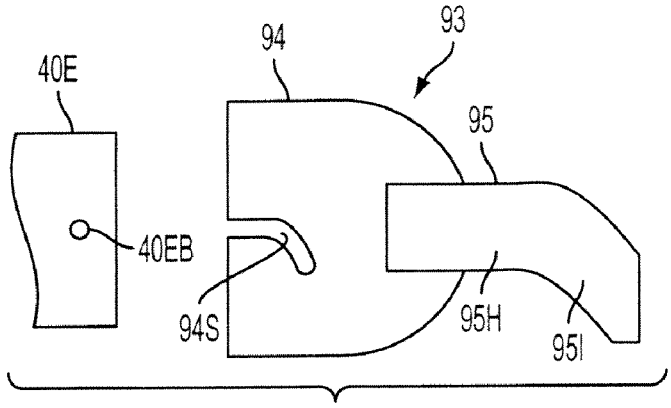
FIG. 14A is a side view of the exhaust assembly.
Figure 14B:
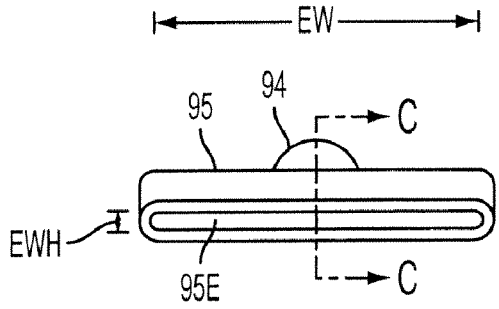
FIG. 14B is a rear view of the exhaust assembly.
Figure 14C:
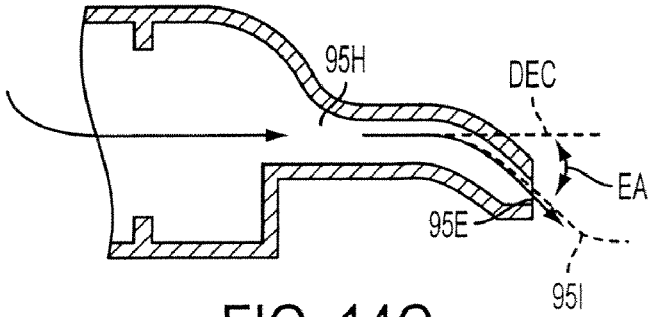
FIG. 14C is a cross-sectional view along line C-C of FIG. 14B.

Another embodiment of the exhaust directing assembly in FIG. 14. Exhaust directing assembly 93 has a body 94, which may have a slot 94S. To install the exhaust directing assembly 93, the user would align slot 94S with bosses 40EB on the dust exhaust 40E, push the exhaust directing assembly 93 along the slot 94S, causing the exhaust directing assembly 93 to twist into a locking position. Persons skilled in the art will recognize that slot 94S and boss 40EB could have been placed on dust exhaust 40E and body 94, respectively.

Body 94 is preferably substantially semispherical. An exhaust 95 is connected to the body 94. Exhaust 95 is preferably elongated along a direction substantially perpendicular to the longitudinal axis of dust exhaust 40E. Preferably the width EW of exhaust 95 is at least 3 times the diameter of dust exhaust 40E or of body 94.

Persons skilled in the art will recognize that the exhaust 95 will have an opening 95E which a width substantially close to width EW. However, the height EWH of opening 95H will be substantially smaller compared to the diameter of dust exhaust 40E or of body 94.

Preferably, exhaust 95 will have a substantially horizontal portion 95H and an inclined portion 95I connected to portion 95H for directing dust downwardly. Persons skilled in the art will recognize that the centerline of the inclined portion 95I is at an angle EA off the centerline DEC of portion 95H. Preferably, angle EA is about 30°.

Figure 15:
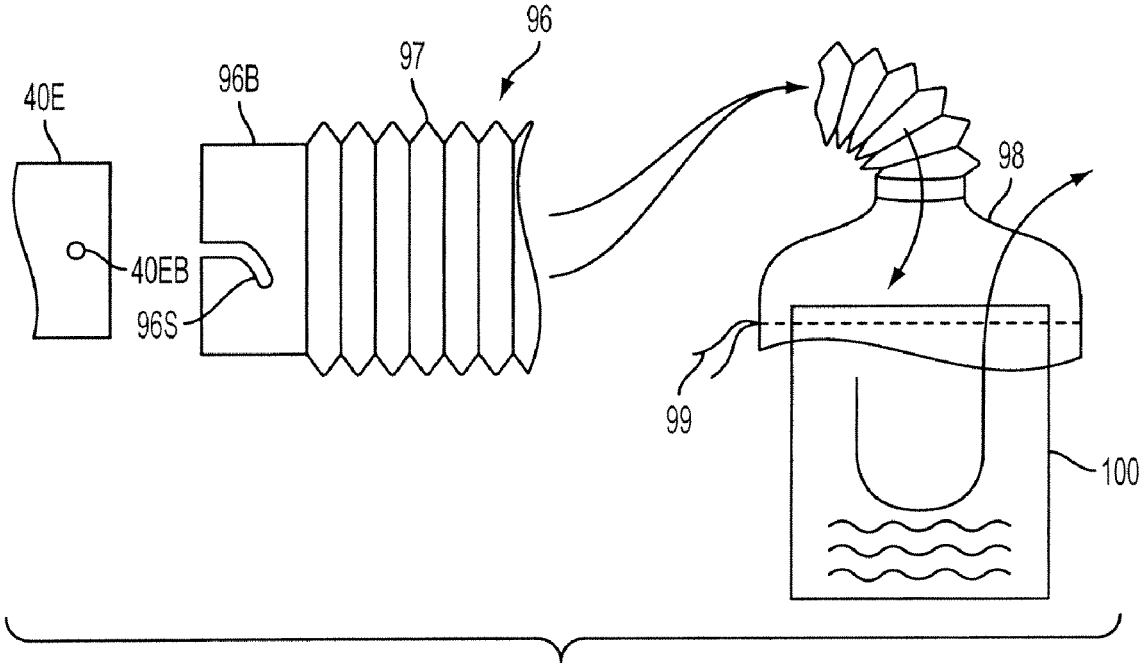
FIG. 15 illustrates a third exhaust assembly to be used with the planing machine.

Another embodiment of the exhaust directing assembly in FIG. 15. Exhaust directing assembly 96 has a body 96B, which may have a slot 96S. To install the exhaust directing assembly 96, the user would align slot 96S with bosses 40EB on the dust exhaust 40E, push the exhaust directing assembly 96 along the slot 96S, causing the exhaust directing assembly 96 to twist into a locking position. Persons skilled in the art will recognize that slot 96S and boss 40EB could have been placed on dust exhaust 40E and body 96B, respectively.

Body 96B may be connected to a hose 97, which is preferably pleated so that it can extend and retract, as is well known in the art. Hose 97 may be connected to a mesh bag 98, which covers the top of a trash can 100. Mesh bag 98 may be held in place via a drawstring 99 around the trash can 100. With such arrangement, dust going through hose 97 can exit into the trash can 100. The air carrying the dust can exit through the mesh bag 98. However, the dust will either settle at the bottom of the trash can 100 or be trapped by the mesh bag 98.

Referring to FIGS. 1 and 8, it is preferable to provide carriage assembly 40 with handles 45.

While the invention has been described in this specification and illustrated in the drawings with reference to a preferred embodiment it would be understood by those skilled in the art that various changes may be made and equivalence may be substituted for elements thereof without departing for the scope of the invention as defined in the claims. In addition, many modifications may be made to a particular situation a material to the teachings of the invention without departing from the essential scope thereof. Therefore, it is intended that the invention not be limited to the particular embodiment illustrated by the drawings and described by the specification as the best mode presently contemplated for carrying out this invention, but that the invention will include any embodiments falling within the foregoing description and the appended claims.

The invention claimed is:

1. A planing machine comprising:

a base;

at least two support columns disposed on the base;

a carriage assembly carrying a cutterhead, the carriage assembly being mounted on the support columns;

one of the base and the carriage assembly being movable vertically towards the other of the base and the carriage assembly; and a wall mounted on one of the base and the carriage assembly and extending between the carriage assembly and the base for preventing user contact with the cutterhead, wherein the wall is wrapped around a roller mounted on the other of the base and the carriage.

2. The machine of claim 1, further comprising a spring mounted to the roller for biasing the roller towards a rest position.

3. A planing machine comprising:

a base;

at least two support columns disposed on the base;

a carriage assembly carrying a cutterhead, the carriage assembly being mounted on the support columns;

one of the base and the carriage assembly being movable vertically towards the other of the base and the carriage assembly; and a wall mounted on one of the base and the carriage assembly and extending between the carriage assembly and the base for preventing user contact with the cutterhead, wherein the other of the base and the carriage assembly has a slot for receiving the wall therethrough.

4. The machine of claim 1, wherein a spring is disposed between the wall and the one of the base and the carriage assembly for biasing the wall towards the other of the base and the carriage assembly.

5. The machine of claim 3, wherein a spring is disposed between the wall and the one of the base and the carriage assembly for biasing the wall towards the other of the base and the carriage assembly.

* * * * *